US005582707A

United States Patent [19]

Chizhevski

[11] Patent Number: 5,582,707

[45] Date of Patent: Dec. 10, 1996

[54] ELECTROLYTE FOR ELECTROPLATING OF CHROMIUM BASED COATING, HAVING IMPROVED WEAR RESISTANCE, CORROSION RESISTANCE AND PLASTICITY

[75] Inventor: Simion Chizhevski, Katzrin, Israel

[73] Assignee: Golan Galvanics, Ltd., Israel

[21] Appl. No.: 338,184

[22] Filed: Nov. 9, 1994

[30] Foreign Application Priority Data

Nov. 9, 1993 [IL] Israel ..... 107544

[51] Int. Cl.[6] ..... C25D 3/04

[52] U.S. Cl. ..... 205/109; 205/242; 106/1.25; 106/1.29

[58] Field of Search ..... 205/243, 283, 205/285, 109; 106/1.25, 1.29

[56] References Cited

U.S. PATENT DOCUMENTS

| | | | |
|---|---|---|---|
| 3,661,733 | 5/1972 | Roggendorf | 204/51 |
| 3,943,040 | 3/1976 | Willson | 204/51 |
| 4,006,072 | 1/1977 | Yakayasu | 204/235 |
| 4,406,756 | 9/1983 | Baranyi | 204/51 |
| 4,615,773 | 10/1986 | Dash et al. | 204/43.1 |
| 4,619,742 | 10/1986 | Pliefke | 204/51 |
| 5,259,937 | 11/1993 | Hatano et al. | 205/159 |

FOREIGN PATENT DOCUMENTS

| | | |
|---|---|---|
| 47041 | 4/1975 | Israel . |
| 58-107497 | 6/1983 | Japan . |
| 59-028640 | 7/1984 | Japan . |
| 59-123792 | 7/1984 | Japan . |

OTHER PUBLICATIONS

Greco et al, "Electrodeposition of Ni–$Al_2O_3$; Ni–$TiO_2$ and Cr–$TiO_2$ Dispersion Hardened Alloys", Plating, Mar. 1968, pp. 250–257.

CA 76: 80 ,292 (1971) no month available.

CA 86 :35 ,695 (1976) no month available.

CA 119 :82 ,207 (1992) no month available.

*Primary Examiner*—Kathryn Gorgos

*Assistant Examiner*—Kishor Mayekar

*Attorney, Agent, or Firm*—Wigman, Cohen, Leitner & Myers, P.C.

[57] ABSTRACT

Electrolyte for electroplating of chromium based coating

The electrolyte consists of:

- a liquid component, containing hexavalent ions of chromium
- a metal component, chosen from the group II of the Periodical Table
- a particulate solid component, comprising a compound of refractory metal of the groups IVb, Vb of VIb of the Periodical Table.

Chromium based coating is electroplated from an electrolytic bath, containing said electrolyte. The coating consists of a matrix, presented by solid solution of chromium with said metal component and of distributed within said matrix particles of a solid component. The coating has improved wear resistance, corrosion resistance and plasticity and it can be deposited both on metallic and non-metallic substrates.

21 Claims, 3 Drawing Sheets

Plasticity comparison of chromium coatings deposited from electrolytes according to the present invention and known electrolytes

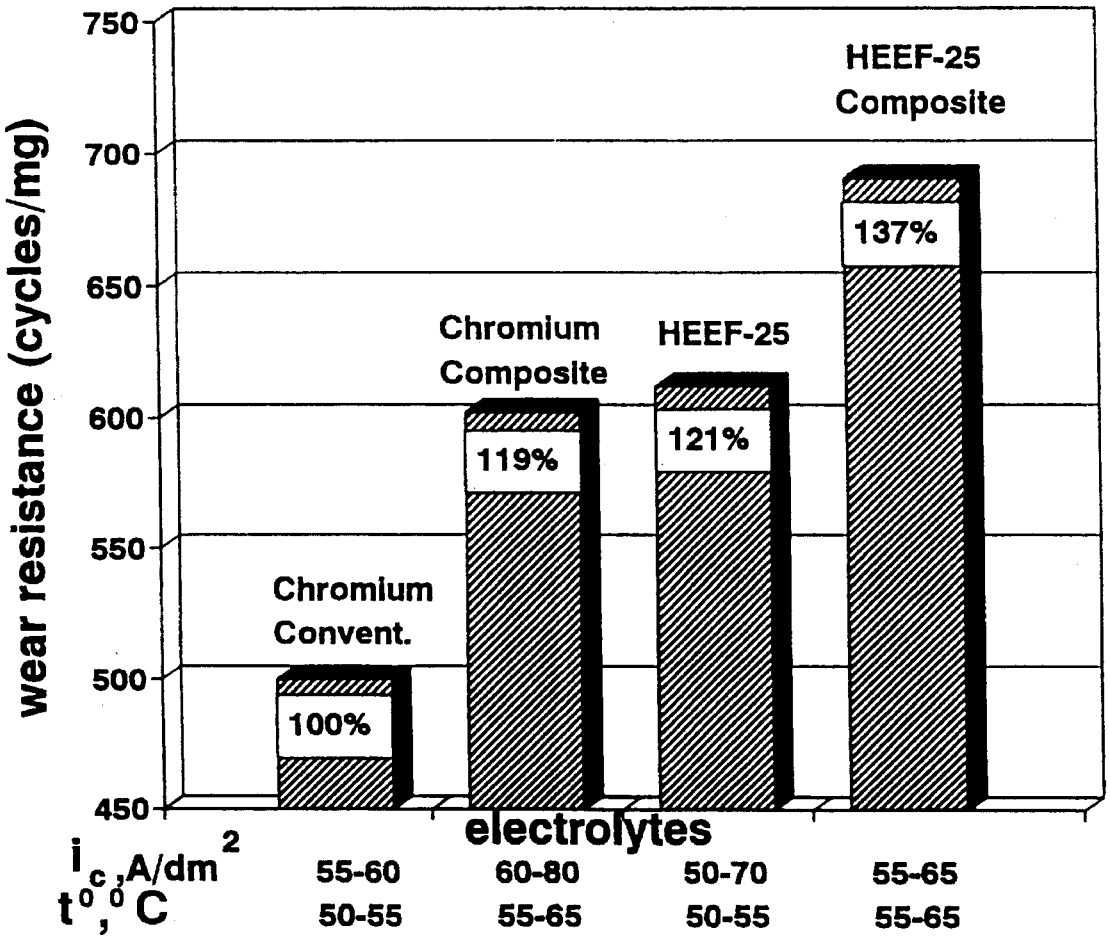
Fig.1 Wear resistance comparison of chromium coatings deposited from electrolytes according to the present invention and known electrolytes

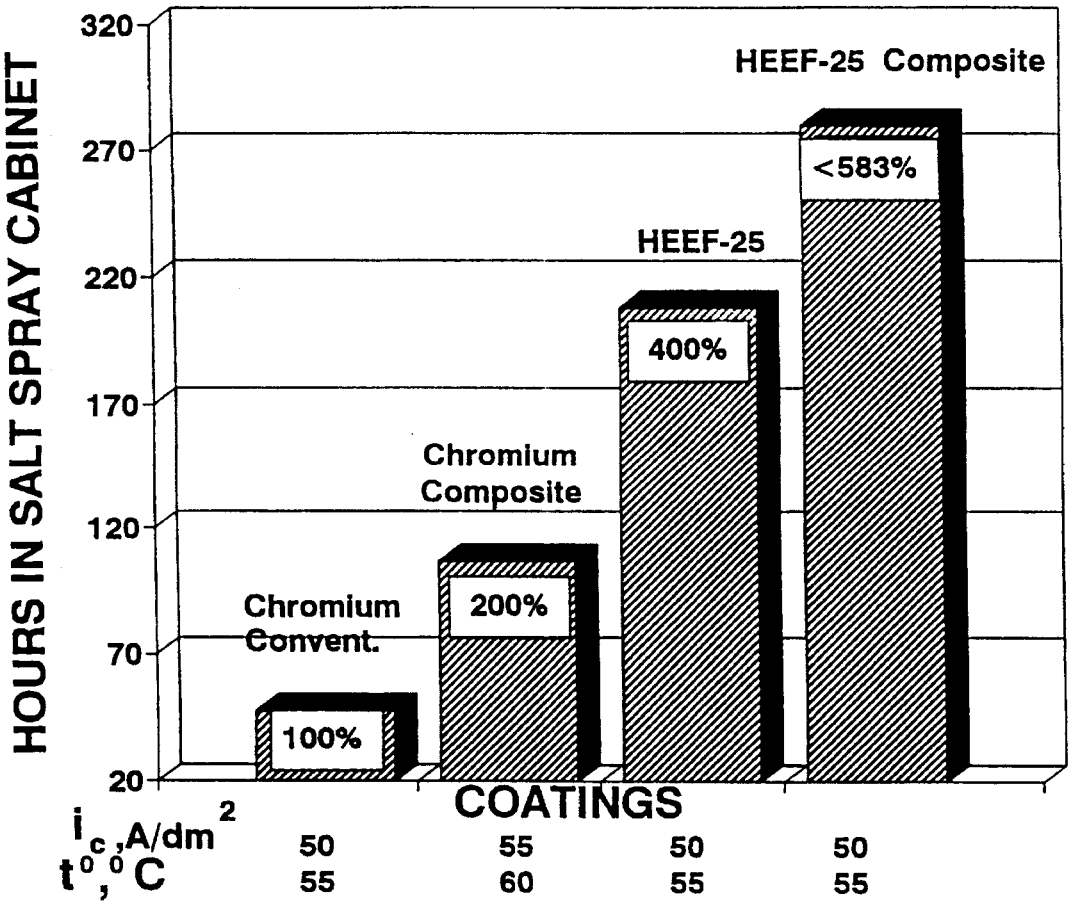
Fig.2 Corrosion resistance comparison of chromium coatings deposited from electrolytes according to the present invention and known electrolytes

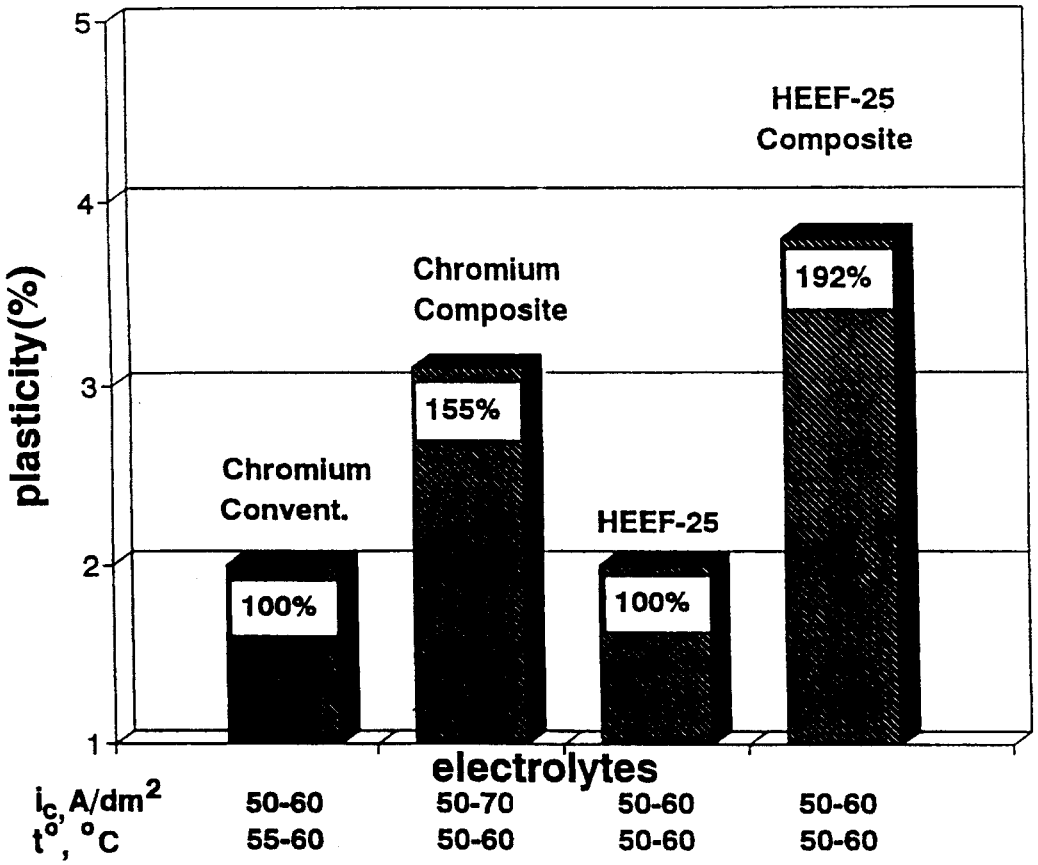
Fig.3 Plasticity comparison of chromium coatings deposited from electrolytes according to the present invention and known electrolytes

ELECTROLYTE FOR ELECTROPLATING OF CHROMIUM BASED COATING, HAVING IMPROVED WEAR RESISTANCE, CORROSION RESISTANCE AND PLASTICITY

FIELD OF THE INVENTION

The present invention relates to electrolytes, used in electroplating, in particular for depositing a metallic layer onto a substrate by making the substrate to be plated the cathode in an electrolytic bath.

More particularly, the present invention relates to electroplating of hard coatings containing chromium onto surfaces of articles which should have prolonged service life especially under conditions of impact load, high wear and corrosion, e.g., components of drilling equipment, pressing, extrusion and injection moulding dies, pressure casting molds, etc. However, the present invention is not limited by the above applications and is also suitable for electroplating of chromium-based coatings onto many other articles for which operating conditions require improved wear resistance in combination with high plasticity and corrosion resistance, e.g. rotating shafts, cylinder linings, different machine parts, piston rings, camshafts, weapon barrels, etc.

BACKGROUND OF THE INVENTION

Electroplating technology for deposition of hard coatings of chromium onto metallic or other substrates has been known at least since the first quarter of the twentieth century when this process was commercialized by the United Chromium Company.

An example of the first electrolytes containing ions of hexavalent chromium and suitable for electroplating of chromium coatings is described, for example, in British patent document GB2372288. Since then electroplating technology has been extensively developed, and today, standard electrolyte is known and widely used for electroplating of chromium coatings. This electrolyte is described in ASTM B177-68. It contains 250–400 g/liter of chromium anhydride and 2,5–4 g/liter of sulfuric acid.

One of the important parameters associated with the electroplating process in general, and the composition of electrolyte in particular, is the current efficiency. This parameter is insufficient for most known electrolytes used for electroplating of chromium, including the above-mentioned standard electrolyte, since low current efficiency is accompanied by prolonged deposition time.

There are known attempts to increase current efficiency by modification of the chemical composition of the electrolyte, e.g., by introducing ions of halogens into the electrolyte bath, as described in Israeli patent IL47041 or compounds of sulfur, as described in U.S. Pat. Nos. 3,943,040 or 4,406,756.

One of the major requirements of an electrolyte is its ability to produce coatings with high wear and corrosion resistance. Developed for this purpose were so-called composite coatings consisting of a chromium matrix containing embedded fine particles of hard insoluble oxide compounds, such as silica, titania, zirconia, and alumina or non-oxide compounds, such as carbides, borides or nitrides of refractory metals.

Typical examples of plating baths suitable for obtaining a composite coating with insoluble solid particles of SiC, $MoSi_2$ and alumina are described, e.g., in Japanese patent 84028640.

In addition to high wear resistance, it is almost always desirable that the deposited coating be corrosion resistant. One of the approaches for improving this property is that the substrate obtain a coating which is presented by an alloy consisting of a solid solution of chromium with another metal, e.g., cobalt, nickel or iron. An example of an electrolyte suitable for chromium-iron solid solution alloy plating is described, e.g., in U.S. Pat. No. 4,615,773.

Although known chromium-based composite coatings consisting of chromium or a chromium solid solution matrix with embedded particles exhibit rather high hardness and wear and corrosion resistance, their plastic properties are deteriorated seeing that improvement of hardness is intrinsically associated with a reduction of ductility. Therefore, plasticity of such composite coatings might be insufficient for articles working under conditions where resistance is required to impact load or fatigue in combination with plasticity.

SUMMARY OF THE INVENTION

The object of the present invention is to provide an electrolyte for electroplating of chromium-based coatings, which sufficiently reduces or overcomes the above-mentioned drawbacks. In particular, the first object of the present invention is to provide an electrolyte composition which allows for electrodeposition of chromium-based composite coatings having improved wear resistance.

The second object of the present invention is to provide an electrolyte which allows for electrodeposition of chromium-based composite coatings with improved plastic properties of the coating.

The third object of the present invention is to provide an electrolyte which allows for electrodeposition of chromium-based composite coating having improved corrosion resistance.

The fourth object of the present invention is to provide an electrolyte of unsophisticated composition, which is compatible with the commercially known and available electrolytes presently employed for electroplating of chromium.

The above and other objects and advantages of the present invention can be achieved in accordance with the following combination of essential features:

- a substantially chromium-based electrolyte for electroplating of composite layer onto a substrate, said electrolyte consisting of:
  - a liquid component which provides a source of substantially hexavalent ions of chromium,
  - at least one metal selected from group IIB of the Periodic Table,
  - a solid component presented by a particulate distributed within said liquid component, characterized in that, composition of said electrolyte comprising
- about 90 to about 95 weight percent of a liquid component,
- about 2 to about 3 weight percent of said metal,
- about 3 to about 7 weight percent of a solid component, said metal and said component selected so as to achieve formation in said composite layer of a matrix presented by solid solution of chromium with said metal and said solid component being dispersed within said matrix.

According to one of the preferred embodiments of the present invention, said additional metal is cadmium and said solid component consists of at least one compound of refractory metal of the groups IVB, VB or VIB of the Periodic Table.

According to a further embodiment, said solid component comprises fine particles of oxide and/or nitride of titanium with specific surface area of at least 15 $m^2$/gram, preferably being in the range of 18–20 $m^2$/gram.

According to an even further particular embodiment of the present invention, its composition comprises:

about 200–300 gram per liter of chromium anhydride about 2–3 gram per liter of sulfuric acid about 5–10 gram per liter of sodium dichromate about 15–30 gram per liter of cadmium about 20–30 gram per liter of titanium nitride about 20–30 gram per liter of titanium dioxide.

According to yet another particular embodiment the composition of the electrolyte includes:

about 15–30 gram per liter of metallic cadmium and about 20–30 gram per liter of titanium nitride.

As per still another particular embodiment the composition of the electrolyte includes:

about 15–30 gram per liter of metallic cadmium and about 20–30 gram per liter of titanium dioxide.

According to still another particular embodiment the composition of said electrolyte includes a current efficiency catalyst.

According to another implementation of the present invention there is provided a composite coating electroplated onto a substrate, said coating consisting of an alloy matrix, presented by a substantially chromium-based solid solution, and dispersed within said matrix insoluble particulate, consisting of fine particles of at least one compound of refractory metal selected from groups IVB, VB or VIB of the Periodic Table, characterized in that said solid solution comprises at least one metal selected from group IIB of the Periodic Table, said coating having about 95–98 weight percent of said matrix and about 5–2 weight percent of said particulate, whereas said metal in said alloy and said particulate are selected so as to ensure simultaneous improvement of wear resistance, corrosion resistance and plasticity of the coating.

According to a further preferred embodiment referring to the above implementation, said solid solution in said coating matrix consists of about 94–95 weight percent of chromium and about 6–15 weight percent of cadmium, said particulate consisting of fine particles of titanium nitride and/or titanium dioxide.

In accordance with one of the further preferred embodiments said coating is deposited onto said substrate from an electrolytic bath, containing an electrolyte with about 200–300 gram per liter of chromium anhydride about 2–3 gram per liter of sulfuric acid about 5–10 gram per liter of sodium dichromate about 15–30 gram per liter of cadmium about 20–50 gram per liter of titanium nitride about 20–40 gram per liter of titanium dioxide whereas said substrate is exposed to said bath at a current density of app. 50–80 A/$dm^2$ and at a plating temperature of 50°–70° C.

In accordance with yet another implementation of the present invention, it results in an article of manufacture comprising a substrate electroplated onto said substrate composite coating, consisting of a matrix, presented by substantially chromium-based solid solution and dispersed within said matrix insoluble particulate, consisting of fine particles of at least one compound of refractory metal selected from groups IVB, VB or VIB of the periodical table, characterized in that said solid solution comprises at least one metal selected from group IIB of the Periodic Table and said coating consisting of about 95–98 weight percent of said matrix and of about 5–2 weight percent of said particulate, whereas said metal in said alloy and said particulate are selected so as to ensure simultaneous improvement of wear resistance, corrosion resistance and plasticity of the coating.

In accordance with one of the preferred embodiments relating to this implementation of the present invention, said substrate is a metallic material, e.g., steel, or a nonmetallic material, e.g., polymeric or ceramic.

The present invention in its various embodiments has only been summarized briefly.

For better understanding of the present invention as well as of its advantages, reference will now be made to the following description of its embodiments, taken in combination with accompanying drawings.

BRIEF DESCRIPTION OF THE DRAWINGS

FIG. 1 shows a diagram presenting a comparison of wear resistance of chromium-based coatings, deposited from known electrolytes and of composite coatings electroplated from the electrolyte according to the present invention.

FIG. 2 shows a diagram presenting a comparison of corrosion resistance of chromium-based coatings deposited from known electrolytes and of composite coating electroplated from the electrolyte according to the present invention.

FIG. 3 shows a diagram presenting a comparison of plasticity of known chromium-based electroplated coatings and composite coating according to the present invention.

DETAILED DESCRIPTION OF SPECIFIC EMBODIMENTS

The invention will be described herein in detail in the following, non-limiting examples and tables.

It has been found that in accordance with the present invention it is possible to obtain an electroplated chromium-based composite coating having improved wear resistance, corrosion resistance and plasticity when the composition of the bath electrolyte consists of:

a basic liquid component providing a source of chromium ions (aqueous solution of chromium anhydride, sulfur acid and the appropriate addition of agents commonly used for the promotion of chromium ion deposition), an additive of anodically dissolved metallic cadmium and an additive of fine particles of nitride and/or dioxide of titanium, having a specific surface of at least 15–20 $m^2$/gram dispersed within the basic liquid component.

In particular it has been found that the following composition (in gram per liter) of the electrolyte is suitable for electroplating of composite coatings with improved properties:

| | |
|---|---|
| Chromium anhydride | 200–300 |
| Sulfur acid | 2,0–3,0 |
| Sodium dichromate | 5–10 |

-continued

| | |
|---|---|
| Metallic cadmium | 15–30 |
| Titanium nitride | 20–50 |
| Titanium dioxide | 20–40 |

Table 1 summarizes examples of electrolyte compositions, particular plating conditions and the properties of composite coatings deposited from these electrolytes.

TABLE 1

Electrolyte compositions, plating conditions and properties of coatings

| | Electrolyte compositions (g/l) | | | | | | Plating conditions | | Coating properties | | |
|---|---|---|---|---|---|---|---|---|---|---|---|
| Example Number 1 | Chromium trioxide $CrO_3$ 2 | Sulfuric acid $H_2SO_4$ 3 | Cadmium Cd 4 | Sodium dichromate $Na_2Cr_2O_7$ 5 | Titanium nitride TiN 6 | Titanium dioxide $TiO_2$ 7 | Cathode current density A/dm$^2$ 8 | Temperature °C. 9 | Microhardness kg/mm$^2$ 10 | Wear resistance h/mcm 11 | Plasticity % 12 |
| Example 1 basic electrolyte | 250 | 2.5 | — | — | — | — | 50 | 50 | 1000 | 0.24 | 3.8 |
| Example 2 | 200 | 1.1 | 17 | 6.5 | — | — | 50 | 50 | 960 | 0.33 | 12.4 |
| Example 3 | 125 | 1.25 | 20 | 10 | 20 | 20 | 50 | 60 | 964 | 0.11 | 10.7 |
| Example 4 | 150 | 1.5 | 20 | 10 | 20 | 20 | 50 | 60 | 1080 | 0.15 | 21.3 |
| Example 5 | 200 | 2.0 | 20 | 10 | 20 | 20 | 60 | 60 | 1090 | 0.29 | 38.4 |
| Example 6 | 250 | 2.5 | 20 | 20 | 20 | — | 80 | 60 | 1190 | 0.27 | 11.1 |
| Example 7 | 250 | 2.5 | 20 | 10 | — | 20 | 80 | 60 | 990 | 0.12 | 29.3 |
| Example 8 | 300 | 3.0 | 20 | 10 | 20 | 20 | 80 | 60 | 990 | 0.10 | 36.7 |
| Example 9 | 250 | 2.5 | — | — | 20 | 20 | 60 | 60 | 1067 | 0.12 | 30.5 |
| Example 10 | 250 | 2.5 | 20 | 10 | 5 | 20 | 80 | 60 | 990 | 0.12 | 29.2 |
| Example 11 | 250 | 2.5 | 20 | 20 | 20 | 30 | 80 | 60 | 1140 | 0.28 | 22.9 |
| Example 12 | 250 | 2.5 | 20 | 10 | 30 | 20 | 60 | 60 | 1178 | 0.16 | 16.5 |
| Example 13 | 250 | 2.5 | 20 | 10 | 20 | 5 | 60 | 60 | 1100 | 0.15 | 21.2 |
| Example 14 | 250 | 2.5 | 5 | 10 | 20 | 20 | 70 | 60 | 1100 | 0.26 | 34.4 |
| Example 15 | 250 | 2.5 | 20 | 20 | 20 | 17 | 60 | 50 | 1169 | 0.45 | 43.4 |
| Example 16 | 250 | 2.5 | 20 | 5 | 20 | 40 | 50 | 50 | 1110 | 0.4 | 39.0 |
| Example 17 | 250 | 2.5 | 20 | 5 | 20 | 20 | 100 | 70 | 1000 | 0.5 | 36.0 |
| Example 18 | 250 | 2.5 | 25 | 10 | 20 | 20 | 60 | 60 | 1120 | 0.67 | 43.8 |
| Example 19 | 250 | 2.5 | 20 | 20 | 18 | 20 | 60 | 60 | 1165 | 0.6 | 43.3 |
| Example 20 | 250 | 2.5 | 20 | 10 | 20 | 20 | 80 | 60 | 1170 | 0.62 | 43.9 |

Preparation of the electrolyte with the above composition included the following steps:

a) An appropriate amount of chromium anhydride (preferably in the form of $CrO_3$ flakes) is dissolved in water in half a volume of the bath, the bath being filled with water to the needed volume. The exact amount of sulfuric acid is then added to the bath, the resulting solution being electrochemically treated to reach a Cr(+3) concentration of 3–5 gram per liter.

b) An aqueous solution of sodium dichromate is prepared separately and then added to the bath.

c) Metallic cadmium is introduced into the same solution by anodic dissolution of the cadmium electrode immersed into the bath containing the above-mentioned aqueous solution at anodic current density of 8–10 A/dm$^2$ and at 45°–50° C.

d) A suspension of fine particles of titanium nitride and titanium dioxide is prepared by mixing the solid particulate preferably with a specific surface of 18–20 m$^2$/gr with a small amount of electrolyte solution.

e) A suspension of dispersed fine particulate is added to the contents of the bath.

Composite coatings with good mechanical properties were obtained when the substrate to be coated had been exposed to the bath with electrolyte prepared according the above at a cathodic current density of 50–80 A/dm$^2$, at a plating temperature of 50°–70° C. and if the plating was accompanied by compressed air barbotage.

Examples 1 and 2 are listed for comparison and refer to prior art standard electrolyte without a cadmium additive, and without a solid particulate additive.

The data on properties summarized in Table 1 were obtained as follows:

1) Wear resistance was measured on steel samples, formed as bushings having a hardness of 40–45 HRc and coated with chromium coating with the thickness of 40–50 microns. The sample bushing was placed inside an immovable steel ring having a hardness of 60–62 HRc; the bushing was then revolved therein at a frequency of 100 rpm. During revolution of the bushing within the ring, a radial load of 100 kg was applied to the bushing so as to cause it to rub against the ring surface. The weight loss of the bushing was measured as a function of time. Wear resistance was then recalculated as time required for establishing 1 micron wear on the coating.

2) Plasticity was assessed by bending the steel samples with 0.5 mm thickness and having a coating layer of 25–30 microns. Before testing the samples were heated for 3 hours at 250°–280° C. in order to prevent hydrogen embrittlement.

In addition to the above properties, the Knoop microhardness was measured under a 50 gram load.

From the results summarized in Table 1 it can easily be seen that electrolytic compositions with the addition of cadmium and/or fine particles of titanium nitride and/or titanium dioxide to aqueous solution of chromium anhydride and sulfuric acid are associated with improvement of wear resistance of the coating, despite the fact that hardness per se of these coatings was increased only insignificantly. On the other hand, plasticity of all the coatings was remarkably improved.

Examples 3–17 show that electroplating at current density of 50–100 A/dm$^2$, at 50°–70° C. from electrolytic bath having an addition of 5–20 grams per liter of cadmium, and 5–40 grams per liter of at least one of the above-mentioned compounds of titanium resulted in composite coating having wear resistance which exceeds that of standard electrolyte by a factor of 1,1–2,1 (examples 5, 6, 11, 14–17) and having plasticity which exceeds that of standard electrolyte by a factor of 2,8–11,4 (examples 3–17).

Examples 18–20 show that electroplating at a current density of 60–80 A/dm$^2$ and temperature of 60° C. from electrolyte having 250 gram per liter of chromium anhydride, 2,5 gram per liter of sulfuric acid, 10–20 gram per liter of sodium dichromate 20–25 gram per liter of cadmium, 18–20 gram per liter of titanium nitride and 20 gram per liter of titanium dioxide resulted in a composite coating with wear resistance exceeding that of the coating deposited from a standard electrolyte by a factor of 2,5–2,8 and with plasticity by a factor of 11,4–11,6.

All composite coatings deposited from electrolytes according to the present invention exhibited bright surfaces with smooth morphology and consisted of a matrix of solid solution of chromium with cadmium and of fine particles of titanium nitride and/or titanium oxide embedded within said matrix Composition of the composite coating was 98–95 weight percent of matrix solid solution and 2–5 weight percent of particulate component.

Composition of the matrix solid solution was

6–15 weight percent of cadmium and

94–85 weight percent of chromium.

Descriptions up to now referred to electrolytes prepared from a basic aqueous solution of chromium anhydride and sulfuric acid including steps a), b), c) and d) as described above for preparation of the basic solution.

However, electrolytes listed in these examples can be advantageously prepared as well by addition of cadmium and solid particulate components in amounts similar to those listed in examples 3–20 of Table 1, to a commercially available ready-to-use chromium basic electrolyte.

This might be especially convenient if the electrolyte according to the present invention should be used in the existing technological line, seeing that there will be no need for neutralization or any other steps associated with replacement of a previously-used electrolyte.

It has been empirically found that it might be especially advantageous for this purpose to use the commercially available product designated as HEEF-25, an electrolyte made by M&T Harshaw, East Kilbridge G74 4QD, United Kingdom. This electrolyte consists of an aqueous solution of chromium anhydride with sulfuric acid and of a catalyst that improves the current efficiency of the electroplating process up to 25% as compared with 13% with the standard basic electrolyte without catalyst.

In Table 2 examples of compositions of new electrolyte are listed according to the present invention consisting of the HEEF-25 product and a cadmium additive and solid particulate compound of titanium. These examples also include compositions based on standard electrolyte with and without solid particulate and show particular conditions of electroplating and properties of obtained composite coatings.

It will be readily appreciated that employment of electrolyte with the composition listed in these examples results in composite coatings with even more improved wear resistance and plasticity, accompanied by improved corrosion resistance as compared with coatings obtained from electrolytes, the compositions of which are listed in Table 1 above.

Wear resistance of new coatings deposited from electrolytes as listed in Table 2 was assessed by resistance to dry abrasion measured on the Taber Abraser 5130 tester as the number of cycles up to a weight loss of 1 milligram.

TABLE 2

Electrolyte compositions, plating conditions and properties of coatings

| Example | Electrolyte composition in g/l | | | | | | Plating Conditions | | Coating Properties | | |
|---|---|---|---|---|---|---|---|---|---|---|---|
| | | | | | | | Current | Temper- | Properties | | |
| Number | $CrO_3$ | $H_2SO_+$ | Catalyst | Cd | TiN | $TiO_2$ | density A/dm$^2$ | ature °C. | WR c/g | CR hr | P % |
| Example 21 | 260 | 2.9 | – | — | — | — | 50–60 | 55–60 | 502 | 48 | 2.0 |
| Example 22 | 255 | 2.6 | – | 20 | 20 | 20 | 50–60 | 55–56 | 669 | 107 | — |
| Example 23 | 245 | 3.0 | + | — | — | — | 50 | 51–55 | — | 208 | — |
| Example 24 | 250–260 | 2.5– | + | — | — | — | 50–70 | 50–60 | 602 | — | 2.0 |
| Example 25 | 245 | 3.0 | + | 28 | 50 | 40 | 50 | 52–55 | — | more than 280 | — |
| Example 26 | 250–260 | 2.5–2.6 | + | 15–18 | 20–50 | 20–40 | 50–70 | 50–70 | 690 | — | 3.8 |

WR — wear resistance, CR — corrosion resistance, P — plasticity

Plasticity was evaluated according to ASTM 489-85 by bending a narrow strip of the coated article over the series of mandrels with diameters from 6 to 50 mm up and by calculation of elongation at the appearance of cracks visible under an optical microscope with ×10 magnification.

Corrosion resistance was tested in conditions of a salt spray cabinet according to ASTM B 117-90 in 5%, NaCl salt spray and at 35° C. Every 24 hours a careful and immediate examination was made to determine the extent of corrosion. The criterion for corrosion resistance was the exposure period up to the appearance of visible corrosion sites.

Electroplating at 50 A/dm$^2$ and at 50°–70° C. from electrolyte based on HEEF-25 with additives according to the present invention resulted in composite coating consisting of a matrix of a solid chromium solution with cadmium and distributed fine particles of compounds of titanium within said matrix .

Example 25 shows that corrosion resistance of such a coating electroplated at 50 A/dm$^2$ and at 52°–55° C. from electrolyte based on HEEF-25 and having 245 gram per liter of chromium anhydride, 3,0 gram per liter of sulfuric acid, catalyst 28 gram per liter of metallic cadmium 50 gram per liter of titanium nitride 40 gram per liter of titanium dioxide resulted in improving of corrosion resistance as compared to that of coatings deposited from commercial HEEF-25 electrolyte without additives (example 23) by a factor of 1,4.

Example 26 demonstrates that electroplating at 50–70 A/dm$^2$ and at 50°–70° C. from electrolyte based on HEEF-25 and having 250–260 gram per liter of chromium anhydride, 2,5–2,6 gram per liter of sulfuric acid catalyst 15–18 gram per liter of metallic cadmium 20–50 gram per liter of titanium nitride 20–40 gram per liter of titanium dioxide resulted in deposition of a composite coating with wear resistance exceeding that of the coating deposited from commercial electrolyte HEEF-25 (example 24) by a factor of 1,1 and with plasticity exceeding that by a factor of 1,9.

With reference to FIGS. 1, 2, 3, summarizing properties of new coatings, it can be readily seen that by virtue of an electrolyte, according to the present invention, it is possible to electroplate chromium-based composite coatings with improved properties, i.e., wear resistance superior to that of coatings deposited from standard basic electrolyte or from HEEF-25 electrolyte by 19 and 16 percent, respectively.

corrosion resistance superior to that of the coating deposited from a standard basic electrolyte or from HEEF-25 electrolyte by 100 and 183 percent, respectively.

plasticity superior to that of the coating deposited from a standard basic electrolyte or from HEEF-25 by 55 and 92 percent, respectively.

It has been established as well that the current efficiency of the electroplating process from HEEF-25 based electrolyte, containing additive according to the present invention is 18–20% being by 1,76 times higher than the current efficiency of electroplating from a standard basic electrolyte.

It will now be shown how the present invention, having improved properties, can be implemented in a manufactured article.

A composite coating according to the present invention was electroplated on the surface of a die which is used for pressing glass fiber material.

The composition of the electrolyte used for electroplating was:

250 gram per liter of chromium anhydride 2,5 gram per liter of sulfuric acid 18 gram per liter of cadmium 20 gram per liter of titanium nitride 20 gram per liter of titanium dioxide.

By virtue of the composite coating electrodeposited from the electrolyte with the above composition, the obtained service life of the die was improved by 10–12 times comparing to that of a die coated by a standard chromium-based coating.

It should be understood that the present invention should not be limited to the above-described examples and embodiments.

It should be understood as well that changes and modifications can be made by one ordinarily skilled in the art, without deviation from the scope of the invention.

Listed below are some of these modifications.

Instead of cadmium it might be appropriate to use other metals included in group IIB of the Periodic Table, e.g., Zn.

Fine particles of Zr, W, Mo compounds or other refractory metals might be used instead of titanium compounds.

The scope of the present invention is defined in the appended claims.

I claim:

1. A substantially chromium-based electrolyte for electroplating of a composite layer onto a substrate, said electrolyte comprising:

from about 90 to about 95 weight percent of a liquid component providing a source of substantially hexavalent chromium ions, from about 2 to about 3 weight percent of ions of cadmium metal, from about 3 to about 7 weight percent of a solid component comprising particles distributed within said liquid component, said solid component consists of at least one refractory compound of the metals selected from groups IVB, VB or VIB of the Periodic Table, said metal ions and said liquid component being selected to achieve formation in said composite layer of a matrix presented by solid solution of chromium with said metal and said solid component being dispersed within said matrix.

2. An electrolyte according to claim 1, wherein said solid component comprises fine particles of oxides and/or nitride of titanium with a specific surface area of about 18–20 m$^2$/gm.

3. An electrolyte according to claim 2, wherein said composition comprises:

as the liquid component:

about 200–300 grams per liter of chromic acid anhydride, about 2–3 grams per liter of sulfuric acid, and about 5–10 grams per liter of sodium dichromate;

as the metal ions:

about 15–30 grams per liter of cadmium ions; and as the solid component:

about 20–30 grams per liter of titanium nitride, and about 20–30 grams per liter of titanium dioxide.

4. An electrolyte according to claim 2, including:

about 15–30 grams per liter of said cadmium ions and about 20–30 grams per liter of said titanium nitride.

5. An electrolyte according to claim 2, including:

about 15–30 grams per liter of said cadmium ions and about 20–30 grams per liter of said titanium oxide.

6. An electrolyte according to claim 2, further including a current efficiency catalyst.

7. The electrolyte according to claim 1, wherein said solid component comprises fine particles taken from the group consisting of titanium oxide, titanium nitride and mixture thereof, said particles having a specific surface area of about at least 15 m$^2$/gm.

8. The electrolyte according to claim 7, having the following composition:

as the liquid component:

about 200–300 grams per liter of chromic acid anhydride, about 2–3 grams per liter of sulfuric acid, and about 5–10 grams per liter of sodium dichromate;

as the metal ions:

about 15–30 grams per liter of cadmium ions; and as the solid component:

about 20–30 grams per liter of titanium nitride, and about 20–30 grams per liter of titanium dioxide.

9. A method for electroplating chromium-based composite coatings onto a substrate comprising the steps of:

providing a chromium-containing electrolytic bath comprising a liquid component which provides a source of hexavalent chromium ions;

adding to the liquid component particles of refractory material, said refractory material is selected from the group consisting of metal oxides, metal nitrides and mixture thereof, said metals are selected from the group of IVB, VB or VIB of the Periodic Table;

adding to the liquid component ions of cadmium metal;

placing the substrate in the electrolytic bath after the addition of said ions and said particles to the bath; and adding to the liquid component ions of cadmium metal;

placing the substrate in the electrolytic bath after the addition of said ions and said particles to the bath; and electroplating the substrate placed therein to obtain a layer of an electrodeposited material which provides improved hardness, corrosion and wear resistance, and improved ductility.

10. The method of claim 9, wherein the ions are added by the process of anodic dissolution of cadmium within the liquid component.

11. The method of claim 10, wherein the refractory material is titanium oxide.

12. The method of claim 10, wherein the refractory material is titanium nitride.

13. The method of claim 10 wherein the refractory material is titanium nitride.

14. The method of claim 10, wherein the electrolytic bath after the addition of said metal ions and said refractory material further includes a catalyst to improve the current efficiency.

15. The method of claim 9, further including the step of suspending by bubbling air through the electrolytic bath the refractory material.

16. The method of claim 9 wherein the refractory material is titanium oxide.

17. The method of claim 9, wherein the electrolytic bath after addition of the metal ions and said refractory material comprises:

about 2 to 3 weight percent of the cadmium ions;

about 3 to about 7 weight percent of particles of the refractory material; and the balance liquid component.

18. The method of claim 17, wherein the refractory material is added in the form of fine particles.

19. The method of claim 9, wherein the liquid component comprises a solution of ions of hexavalent chromium, sulfuric acid and dichromate.

20. The method of claim 19, wherein the electrolytic bath after the addition of said metal ions and said refractory component further includes a catalyst to improve current efficiency.

21. The method of claim 9, wherein the refractory material is a mixture of metal oxides and metal nitrides.

* * * * *